US007896789B2

(12) United States Patent
Hinton et al.

(10) Patent No.: US 7,896,789 B2
(45) Date of Patent: Mar. 1, 2011

(54) PUSH UP EXERCISE DEVICE WITH ADJUSTABLE ROTATION RESISTANCE

(75) Inventors: James Hinton, Richmond, TX (US); Chris Neighbors, Pearland, TX (US)

(73) Assignee: James Hinton, Richmond, TX (US)

( * ) Notice: Subject to any disclaimer, the term of this patent is extended or adjusted under 35 U.S.C. 154(b) by 0 days.

(21) Appl. No.: 12/708,495

(22) Filed: Feb. 18, 2010

(65) Prior Publication Data

US 2010/0210431 A1 Aug. 19, 2010

Related U.S. Application Data

(60) Provisional application No. 61/153,511, filed on Feb. 18, 2009.

(51) Int. Cl.
*A63B 26/00* (2006.01)

(52) U.S. Cl. ..... 482/141; 482/62

(58) Field of Classification Search ..... 482/141, 482/62, 51, 126, 139, 44, 907, 57; D21/665, D21/662, 725; D8/DIG. 8, 303; 74/555.1; 280/200; 188/24.11
See application file for complete search history.

(56) References Cited

U.S. PATENT DOCUMENTS

| | | | | | |
|---|---|---|---|---|---|
| 4,768,778 | A * | 9/1988 | Thomas, Jr. | 482/141 |
| 4,858,912 | A * | 8/1989 | Boyd | 482/45 |
| 5,358,463 | A * | 10/1994 | Fuentes | 482/141 |
| 5,632,707 | A * | 5/1997 | Daniel et al. | 482/8 |
| 5,683,337 | A * | 11/1997 | Zetocha et al. | 482/146 |
| 7,326,153 | B2 * | 2/2008 | Bond | 482/92 |
| 7,377,888 | B2 * | 5/2008 | Godbold | 482/141 |
| D579,503 | S * | 10/2008 | Hauser et al. | D21/662 |
| 7,468,025 | B2 * | 12/2008 | Hauser et al. | 482/141 |
| 7,503,884 | B1 * | 3/2009 | Schall | 482/141 |
| 7,553,267 | B1 * | 6/2009 | Hauser et al. | 482/141 |
| D597,153 | S * | 7/2009 | Friedman et al. | D21/662 |
| D599,417 | S * | 9/2009 | Friedman et al. | D21/662 |
| 7,678,031 | B2 * | 3/2010 | Ngu | 482/107 |
| 2004/0266593 | A1 * | 12/2004 | Schwendeman | 482/140 |
| 2005/0085352 | A1 * | 4/2005 | Baxter | 482/100 |
| 2006/0014615 | A1 * | 1/2006 | Godbold | 482/141 |
| 2006/0035771 | A1 * | 2/2006 | Gant | 482/141 |
| 2006/0040809 | A1 * | 2/2006 | Godbold | 482/141 |
| 2007/0265146 | A1 * | 11/2007 | Kowalczewski et al. | 482/92 |
| 2007/0298943 | A1 * | 12/2007 | Mehta | 482/115 |
| 2010/0130337 | A1 * | 5/2010 | Stewart | 482/121 |

* cited by examiner

*Primary Examiner* — Lori Baker
(74) *Attorney, Agent, or Firm* — Richard A. Fagin

(57) ABSTRACT

A pushup exercise device includes a handle affixed to a handle base. The device includes a base plate. The handle base is rotatably supported on the base plate. A brake is disposed in the handle base and surrounds an extension on the base plate. The brake includes an adjuster disposed in the handle base to enable selection of resistance to rotation between the handle base and the base plate.

3 Claims, 2 Drawing Sheets

PUSH UP EXERCISE DEVICE WITH ADJUSTABLE ROTATION RESISTANCE

CROSS-REFERENCE TO RELATED APPLICATIONS

Priority is claimed from U.S. Provisional Application No. 61/153,511 filed on Feb. 18, 2009.

STATEMENT REGARDING FEDERALLY SPONSORED RESEARCH OR DEVELOPMENT

Not applicable.

BACKGROUND OF THE INVENTION

1. Field of the Invention

The invention relates generally to the field of exercise devices. More specifically the invention relates to devices to enable wrist/forearm rotation during push up exercises.

2. Background Art

When people perform push-ups using push-up exercise devices known in the art, their potential for significant muscle conditioning gains are limited. This is due to the fact that many known devices such as pushup bars or other rotational push up devices offer the user no resistance to rotation. Fixed handles limit the potential for improved grip strength. Furthermore, some devices are not storage friendly.

A typical rotational push up exercise device that has no resistance to rotation is described in U.S. Pat. No. 7,468,025 issued to Hauser et al.

There continues to be a need for improved push up exercise devices.

SUMMARY OF THE INVENTION

A pushup exercise device includes a handle affixed to a handle base. The device includes a base plate. The handle base is rotatably supported on the base plate. A brake is disposed in the handle base and surrounds an extension on the base plate. The brake includes an adjuster disposed in the handle base to enable selection of resistance to rotation between the handle base and the base plate.

Other aspects and advantages of the invention will be apparent from the following description and the appended claims.

DETAILED DESCRIPTION

Figure 1:
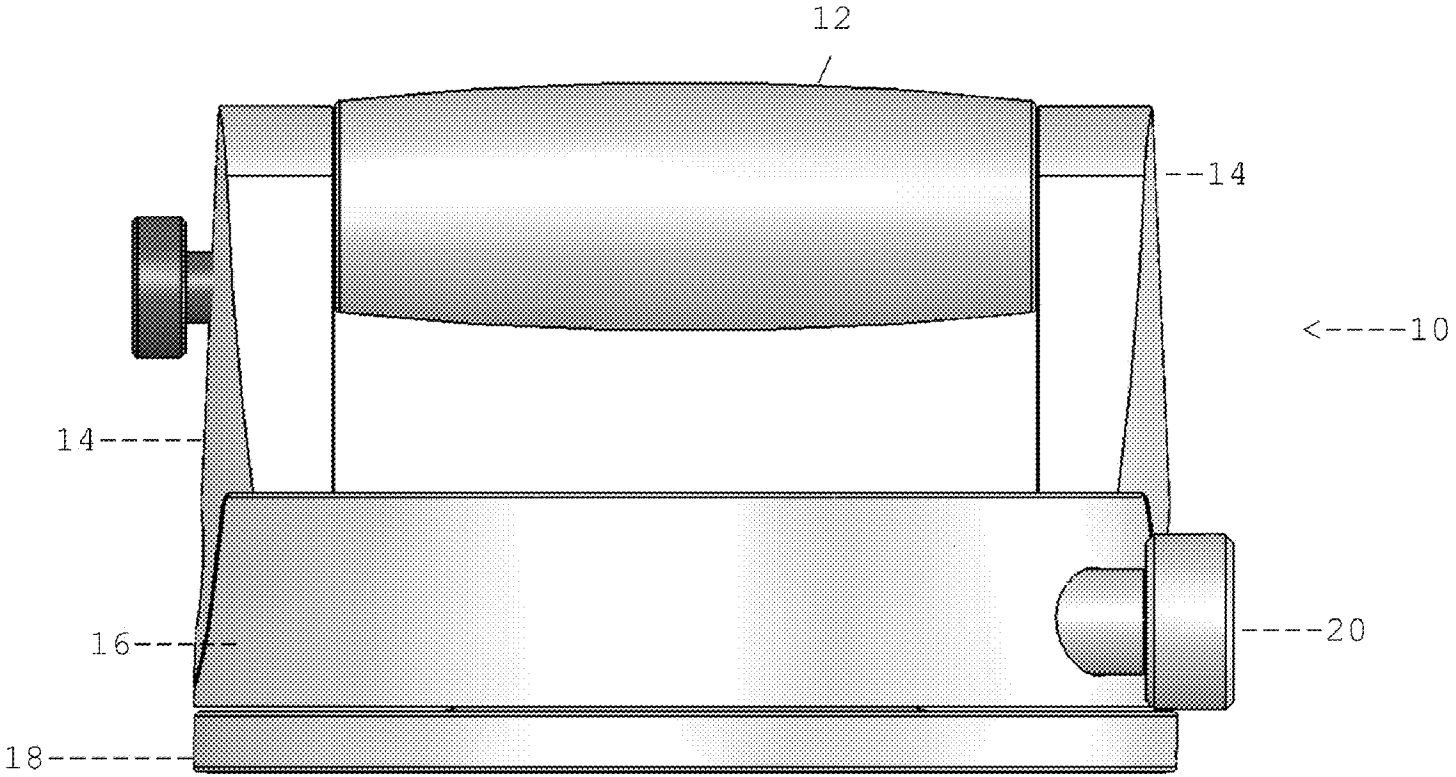
FIG. 1 is an assembled view of one example of a push up exercise device according to the invention

FIG. 1 shows an assembled side view of an example push up exercise device (device) 10. The device 10 includes a handle 12 to be gripped by the user. The handle may be supported at a suitable elevation above a handle base 16 using side mounts 14. The handle base 16 is rotatably supported on a base plate 18. As will be further explained below with reference to FIG. 1, the handle base 16 is rotatably supported on the base plate 18, and includes an adjustable force brake (FIG. 2) that adjustably changes the force required to rotate the handle base 16 while the base plate 18 remains rotationally fixed. The amount of braking force may be selected by the user by rotating an adjusting knob 20 that is disposed in the handle base 16.

Figure 2:
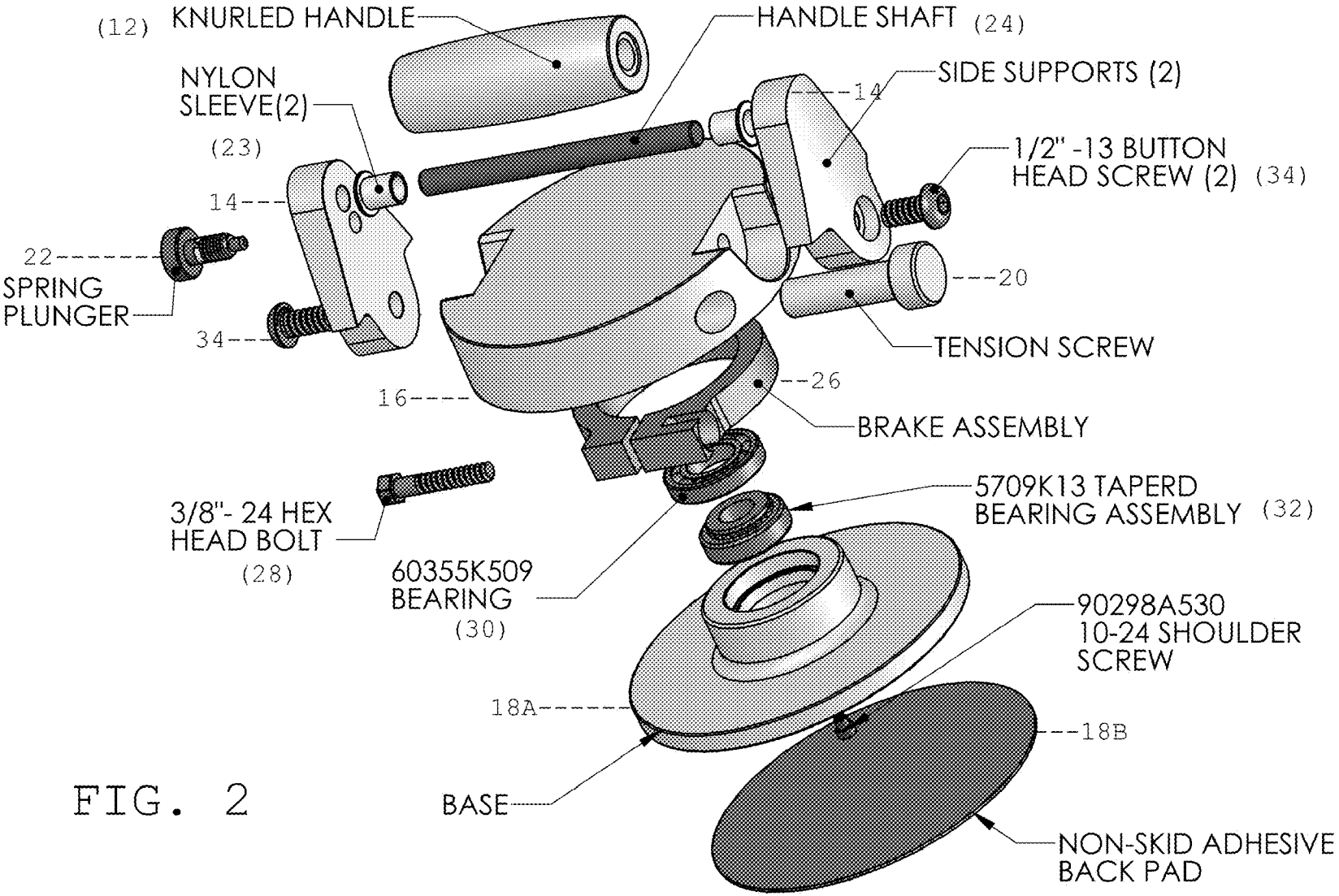
FIG. 2 is an exploded view of the example device shown in FIG. 1.

FIG. 2 shows an exploded view of the device 10 to illustrate the functional components therein. The handle 12 is supported by a handle shaft 24 that passes through openings in the side supports 14. The handle shaft 24 may include nylon or similar material bushings 23 to be inserted in the openings in the side supports. A spring plunger 22 may be inserted into an offset opening 22A in one of the side supports 14 and into the handle 12 if the user desires to have the handle 12 not rotate with respect to the handle base 16.

The side supports 14 may be affixed to the handle base 16 using cap screws 34 or similar threaded fasteners. Rotational support for the handle base 16 may be provided by one or more bearings 30, 32 that into a suitably shaped recess or other feature on the underside of the handle base 16, while the bearings 30, 32 may be disposed in the interior of an extension 18A of the base plate 18. A band-type brake 26 may be affixed, disposed or otherwise placed on the underside of the handle base 16 so as to be rotationally fixed to the handle base 16. When the handle base 16 is assembled to the base plate 18, the brake 26 is disposed around the base plate extension 18A. A capscrew, bolt or similar threaded fastener 28 may pass through suitably shaped band ends 26A, 26B on the brake 26. The threads on the fastener 28 engage mating threads in the adjusting knob 20. When the adjusting knob 20 is rotated by the user, the amount of clamping force applied to the band ends 26A, 26B will change, thus changing the amount of clamping force applied by the brake 26 to the base plate extension 18A. Because the brake 26 is rotationally fixed to the handle base 16, clamping force applied to the base plate extension 18A will cause resistance to rotation of the handle base 16 with respect to the base plate 18. Thus, the user can select the amount of resistance to rotation of the device 10 to suit his personal requirements. In one example, the brake 26 can be made from self-lubricating plastic sold under the trademark NYLATRON, which is a registered trademark of Quadrant EPP USA Inc., 2120 Fairmont Ave., Reading, Pa. 19605.

The base plate 18 may include a skid resistant pad 18B on the bottom face thereof to resist slipping when the device 10 is used. The pad 18B may be adhesively bonded to the bottom surface of the base plate 18.

A push up exercise device made according to the invention may allow the user to easily control resistance to rotation of the handle, may provide for a handle that rotates about its longitudinal axis or may be rotationally fixed, is simple to construct and is durable.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A pushup exercise device, comprising:

a handle affixed to a handle base;

a base plate, the handle base rotatably supported on the base plate; and a brake disposed in the handle base and surrounding an extension on the base plate, the brake including a band having band ends and an adjuster disposed in the handle base to enable selection of resistance to rotation between the handle base and the base plate, wherein the adjuster comprises a threaded fastener extending through the band ends and a knob having mating threads engaged to threads on the fastener.

2. The device of claim 1 wherein the handle is affixed to the handle base by side supports affixed proximate an outer edge of the handle support, the side supports suspending the handle at a selected elevation about an upper surface of the handle base.

3. The device of claim 2 further comprising a spring plunger insertable through an opening in one of the side supports to engage the handle such that the handle is rotationally fixed.

* * * * *